United States Patent [19]

Thompson

[11] Patent Number: 4,848,123

[45] Date of Patent: Jul. 18, 1989

[54] SHOT PEENING MASS FLOW AND VELOCITY SENSING SYSTEM AND METHOD

[75] Inventor: Robert A. Thompson, Quaker Street, N.Y.

[73] Assignee: General Electric Company, Schenectady, N.Y.

[21] Appl. No.: 265,382

[22] Filed: Oct. 31, 1988

Related U.S. Application Data

[63] Continuation-in-part of Ser. No. 188,828, May 2, 1988.

[51] Int. Cl.[4] ..... B24C 1/10

[52] U.S. Cl. ..... 72/53; 29/90.7; 73/861.71; 73/861.72; 73/11; 51/319; 51/439

[58] Field of Search ..... 72/53, 8, 15; 51/439, 51/415, 319, 438, 320; 73/861.73, 861.72, 861.71, 11, 12, 865.9, 290, 215; 29/90.7

[56] References Cited

U.S. PATENT DOCUMENTS

| | | | |
|---|---|---|---|
| 1,367,353 | 2/1921 | Craig | 73/11 |
| 2,316,255 | 4/1943 | Knobel et al. | 73/861.75 |
| 2,607,213 | 8/1952 | Barton | 73/12 |
| 3,212,330 | 10/1965 | De Pollier | 73/861.73 |
| 3,293,913 | 12/1966 | Hannon | 73/861.72 |
| 3,304,773 | 2/1967 | Rogallo | 73/12 |
| 3,695,091 | 10/1972 | Smith | 73/11 |
| 4,067,238 | 1/1978 | Oetiker | 73/861.73 |
| 4,420,957 | 12/1983 | Weber | 72/53 |
| 4,470,292 | 9/1984 | DeClark et al. | 73/861.73 |
| 4,614,100 | 9/1986 | Green et al. | 72/53 |
| 4,693,102 | 9/1987 | Amy et al. | 72/53 |

OTHER PUBLICATIONS

Electronics Inc. Model 260 Shot Flow Meter Installation Manual & Installation Information, 8/20/86.

*Primary Examiner*—David Jones

*Attorney, Agent, or Firm*—Paul R. Webb, II; James C. Davis, Jr.

[57] ABSTRACT

Consistency in shot peening is obtained by a system which uses a force sensor to sense the reaction force from a shot peening gun in combination with a magnetic densitometer sensing coil disposed at the outlet of the nozzle of the shot peening gun. A signal representative of the reaction force due to the ejected shot and a signal representative of the ferromagnetic shot within the sensing coil are used to calculate the average shot particle velocity and the mass flow rate. Additionally, alarm circuitry is provided to ensure that the system is properly operating.

20 Claims, 4 Drawing Sheets

SHOT PEENING MASS FLOW AND VELOCITY SENSING SYSTEM AND METHOD

CROSS-REFERENCE TO RELATED APPLICATION

The present application is a continuation-in-part application of the present inventor's prior application entitled "SHOT SENSING SHOT PEENING SYSTEM AND METHOD", Ser. No. 188,828, filed May 2, 1988, assigned to the assignee of the present application and hereby incorporated by reference.

BACKGROUND OF THE INVENTION

The present invention relates to shot peening and, more specifically, shot peening wherein the shot mass flow rate and the average velocity of the shot are calculated.

The use of shot peening is relatively well known. In particular, a stream of shot (i.e., particles) is directed at a surface at high velocity. The shot is directed at the surface on a workpiece so as to cause plastic deformation of the surface of the workpiece, often a metal surface. The shot peening is often used to increase fatigue strength, although the process may be applied for other purposes.

Various shot peening devices and techniques have been developed over the years.

Shot peening systems generally have (or can be readily equipped with) mass flow controllers. Such controllers are used to control the flow of shot to the shot peening gun. One common type of mass flow controller for use with shot made from magnetic material has an electromagnet which is pulsed in order to allow passage of a metered amount of shot into a shot peening gun. This common type of mass flow controller uses internal feedback to stabilize the mass flow rate (i.e., the amount of shot metered in a given time). A control may be used to set the mass flow rate to a desired value. A display is often used to indicate the flow rate.

As part of a mass flow controller, or as a separate component, prior shot peening systems have included various shot flow meters which provide an indication of the flow rate of the shot. The shot flow meter might be a magnetic densitometer, an example of which is the Model 260 Shot Flow Meter manufactured by Electronics Incorporated of Mishawaki, Ind.

The sensor of the magnetic densitometer, as typified by the Model 260, is a wire coil wound around a tube through which the shot travels vertically. Basically, the device measures the amount of shot under the coil at a given time by sensing the inductance of the coil. In the length of time it takes a particle of shot to traverse the length of the coil, the shot in the coil is fully replaced by new shot.

Therefore, if

L=coil length (inches)

T=time for shot to pass through coil (sec.)

v=shot velocity (in./sec.)

m=amount of shot inside the coil (lbs.) and

R=shot mass flow rate (lbs./sec.), the mass flow rate of shot through the coil is:

$$R=m/T \text{ (lbs./sec.)} \quad (1)$$

and $$v=L/T \text{ (in./sec.)} \quad (2)$$

such that $$R=mv/L \text{ (lbs./sec.)} \quad (3)$$

In order to solve for the mass flow rate R, the coil of the magnetic densitometer of Model 260 is installed in the shot feed line vertically beneath the shot flow control valve. From ballistics, the average velocity v of the freely falling shot in the coil is a known constant.

Since the densitometer measures m and the values v and L are known constants in this configuration, the signal processing section of the flow meter performs equation 3 and develops a signal representative of the mass flow rate R.

The most important process parameters in a shot peening operation are the velocity of individual shot particles and the shot mass flow rate. The flow rate determines how quickly the entire surface will be impacted. If the flow rate is too small for a given exposure time, some areas of the surface will remain untreated after the exposure is over. On the other hand, if the mass flow rate is too large, excessive surface cold work may result in surface damage and increased susceptibility to fatigue. Shot velocity establishes the amount of energy or cold work delivered with each impact which in turn controls the surface profile and depth of the compressive layer. The shot particle energy is one-half of the particle mass times the particle velocity squared. The dependence of this kinetic energy upon the particle velocity makes it clear that the shot particle velocity is an important factor in determining the quality of the shot peening.

Although some measurement techniques have been used in conjunction with the shot peening process, most such prior techniques have been inadequate to conveniently and inexpensively provide an indication of the quality of the shot peening technique. The general absence of simple and inexpensive techniques to measure the quality of shot peening inhibits one's confidence that consistent shot peening results can be obtained.

Further, some shot peening systems are unable to detect a malfunction such as a clogged nozzle or an air leak and take corrective action. This inability to detect malfunctions may result in work pieces going through the process without being shot peened.

A further problem is that some prior techniques require measurement of the mass flow rate adjacent to a shot hopper and at a significant distance from the gun. The problem with this approach is that inaccuracies in measurement may occur due to variations in the shot stream characteristics between the sensor and the gun due to flow instability, leakage, kinking, plugging of the shot hose, or other factors. Depending upon the variations in the shot stream characteristics, such measurement errors may be significant.

OBJECTS AND SUMMARY OF THE INVENTION

A primary object of the present invention is to provide a new and improved shot peening system and method.

A more specific object of the present invention is to provide for the quantifying of shot peening parameters so as to facilitate consistent results.

A further object of the present invention is to provide for highly accurate measurements of shot peening by using sensors on the shot peening gun itself to eliminate inaccuracies which may otherwise be introduced.

A still further object of the present invention is to provide for the detection of malfunctions which may otherwise interfere with proper shot peening.

Yet another object of the present invention is to provide an arrangement which may be readily used with preexisting shot peening guns.

The above and other objects of the present invention which will become more apparent as the description proceeds are realized by a shot peening system including a shot peening gun having a nozzle with an outlet. A sensor is adjacent the outlet to sense the amount of shot within a zone in the shot blast path. The sensor includes a coil adjacent to the outlet and a sensing circuit operable to sense the amount of ferromagnetic shot within the coil by sensing the inductance of the coil. The sensing circuit generates an amount signal representative of the amount of shot within the coil. The shot peening gun is supported by a mounting base and a force sensor which senses the reaction force from operation of the gun. The force sensor is used with an arrangement to generate a signal representative of the reaction force due to the shot which is expelled from the gun. The reaction force is related to the unknown shot velocity and the unknown mass flow rate. As the amount signal representative of the amount of shot within the coil depends upon the known length of the sensor coil and the unknown shot velocity and unknown mass flow rate, the sensor coil and the force sensor together provide two equations with two unknowns, the average shot velocity and the mass flow rate. Therefore, the two unknowns are solved by a series of calculations. Thus, the average shot velocity and/or the mass flow rate can be determined by use of sensors which are located at the shot peening gun and provide quite accurate results since the measurements would not be affected by variations in the shot stream characteristics between a sensor and the gun.

The method of the present invention includes supplying shot to a gun for shot peening, operating the gun to expel shot from a nozzle of a gun, sensing the amount of shot within a volume adjacent a nozzle outlet of the gun, and sensing the reaction force of the gun to generate a force signal. The method further includes calculating a velocity signal representative of the average velocity of shot from the nozzle outlet and/or calculating a mass flow rate signal representative of the flow rate of shot applied to the surface of a work piece which is being shot peened. Preferably, both the average velocity signal and the mass flow rate signal are calculated and the mass flow rate and average velocity are displayed.

Testing circuitry is used to trigger an alarm and/or turn off various components in the system upon detecting a malfunction as indicated by the sensed reaction force, amount of shot within the sensing coil, mass flow rate, and/or average shot velocity.

BRIEF DESCRIPTION OF THE DRAWINGS

The above and other features of the present invention will be more readily understood when the following detailed description is considered in conjunction with the accompanying drawings wherein like characters represent like parts throughout the several views and in which.

DETAILED DESCRIPTION

Figure 1:
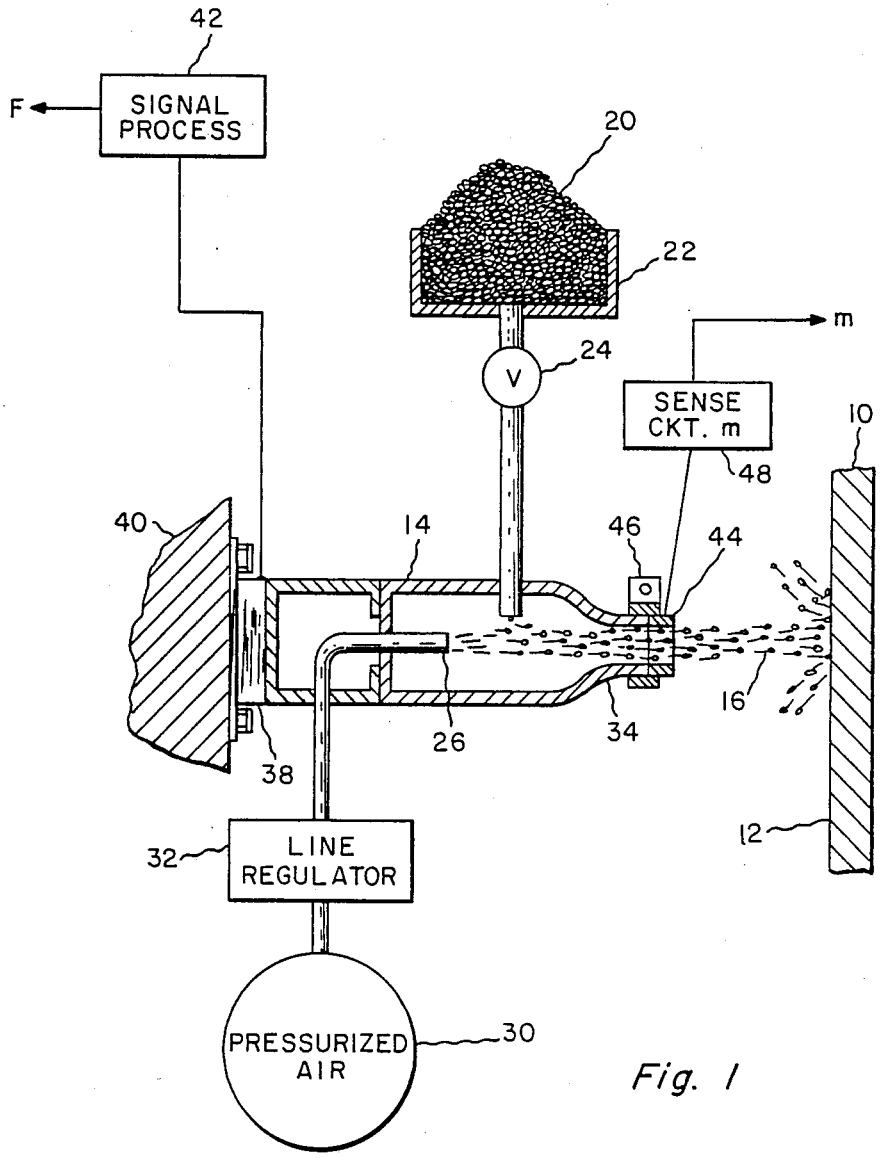
FIG. 1 shows a schematic of the shot peening system of the present invention in conjunction with a side cross section view of a shot peening gun having a first embodiment sensor.

FIG. 1 shows a shot peening operation according to the present invention. In particular, work piece 10 has a surface 12 which is being subjected to shot peening from a shot peening gun 14. The shot peening gun 14 establishes a shot blast path 16 by expelling shot supplied to gun 14 through shot feed line 18 which carries shot 20 from hopper 22. The shot is supplied to feed line 18 by way of a flow controller 24. The flow controller may be a common type of flow controller using an electromagnetic to dispense metered amounts of metallic shot, although other types of flow controllers might be used.

The flow controller 24 might also supply a mass flow rate signal in known fashion through a control line (not shown). However, the present invention will determine the mass flow rate through an advantageous alternate technique, discussed in more detail below, which avoids inaccuracies in the rate which might be caused by a blockage between the mass flow controller 24 and the gun 14.

The shot supplied to the gun 14 from feed line 18 is entrained in pressurized air from an air nozzle 26 at the end of air supply conduit 28. The air supply conduit 28 provides pressurized air from pressurized air source 30 by way of line regulator 32, which is used in known fashion to regulate and adjust the air pressure supplied to the gun 14. The pressure of the air supplied to the nozzle 26, among other factors, helps to determine the velocity of shot expelled from the nozzle 34 and the gun 14. The gun 14 is mounted to a bracket 36.

The components of FIG. 1 which are discussed above are relatively standard components. The shot peening gun 14 is a gravity type of shot peening gun. Although the present invention will work with other types of shot peening guns such as suction lift guns or pressure pot guns, the description will concentrate on the use of the present invention in conjunction with the gravity shot peening gun.

The gun 14 includes a bracket 36 which is mounted upon a force sensor 38. The force sensor 38 is disposed between the gun 14 and mounting base 40 which supports the gun 14. The force sensor 38 is preferably of directional strain gauges which will detect forces parallel to the direction in which the shot is ejected from gun 14. In other words, the force sensor 38 will be essentially independent of vertical forces such as gravity acting upon the gun 14. However, the force sensor 38 will detect the reaction force of the gun 14 as it ejects the shot in path 16. The force sensor 38 is connected to a signal processing circuit 42 which supplies a force signal F. Although other force sensors could be used, the force sensor 38 may be a commercially available Lebow load cell Model 3397 and the signal processing circuit may be a corresponding transducer instrument 7530, these two components often being sold as a package. The signal processing circuit 42 basically converts the output from force sensor 38 into a form corresponding to pounds of force such that the output may be displayed and/or recorded. The use of such a force sensor in shot peening measurement is discussed in the present inventor's U.S. patent application Ser. No. 138,004, filed Dec. 28, 1987 now U.S. Pat. No. 4,805,429 entitled "SHOT PEENING SYSTEM AND METHOD WITH VELOCITY SENSING", assigned to the assignee of the present invention and hereby incorporated by reference.

Mounted adjacent the outlet of nozzle 34 is a sensor 44 which is secured in position by a ring clamp 46. The detailed structure of the sensor 44 will be discussed in detail below, but it should be noted here that the sensor 44 includes a coil (not separately shown in FIG. 1) which is electrically connected to a sensing circuit 48. The sensor 44 including the sensing circuit 48 operates as a magnetic densitometer in known fashion. More specifically, the sensing circuit 48 internally generates a signal based upon the inductance of the coil within sensor 44. As the inductance of the coil within sensor 44 depends upon the amount of ferromagnetic shot within the coil, the sensing circuit 48 generates an output m representative of the mass of ferromagnetic shot within the confines of the coil. The coil senses the shot in a portion of the shot blast path 16, which path extends from the outlet of feed line 18 to the surface 12. As the details of the calculations used to generate a mass signal from a coil in a magnetic densitometer are relatively well known, the need not be discussed in detail. The use of such a sensor disposed at a nozzle outlet is disclosed in the previously discussed parent application Ser. No. 188,826. Since the present invention includes portions of the design of Ser. No. 138,004 now U.S. Pat. No. 4,805,429 as well as portions of the Ser. No. 188,828 design, it will be appreciated that the present invention may incorporate other features from those two other applications.

Figure 2:
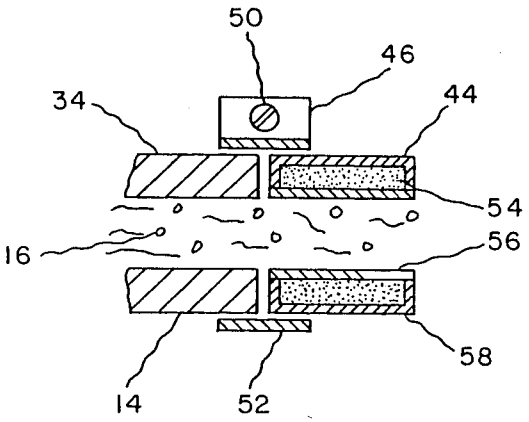
FIG. 2 shows an enlarged cross-section view of part of the first embodiment sensor.

Turning now to FIG. 2, the details of the structure of sensor 44 will be discussed. The view of FIG. 2 shows a cross section of the sensor 44 at the tip of nozzle 34 of the gun 14. The sensor 44 may be clamped onto the end of the nozzle by a ring claim 46 having a screw 50 to tighten it. The ring clamp 46 may be of the same general type as a commonly used hose clamp for securing a garden hose to an inside connector. As such, it has a ring 52 which is tightened by tightening the screw 50. The sensor 44 is cylindrical and of the same outside diameter as the tip of the nozzle 34 such that the hose clamp 46 may mate to the outside diameter of the nozzle and the outside diameter of sensor 44. The sensor 44 has a coil 54 which is disposed on a non-ferromagnetic core 56. A steel flux concentrator 58 extends around three sides of the cross-section of the coil 54. The coil 54, core 56, and concentrator 58 each extend cylindrically around the outlet at the tip of nozzle 34. The preferred material for the core 56 is polyethylene so as to protect the coil 54 from the relatively hostile environment corresponding to the shot. In addition to keeping out foreign material, the ring-like steel flux concentrator 58 concentrates the magnetic field set up by coil 54 to a zone within the coil 54.

The arrangement for the sensor 44 of FIG. 2 makes the present system applicable to a preexisting shot peening gun 14 (only partially shown in FIG. 2). The sensor 44 may easily be clamped by the hose clamp 46 to the end of a preexisting shot peening gun. Alternately, a bracket (not shown) or series of brackets (not shown) could be used to mount the sensor 44 to the tip of nozzle end of the gun 14. When using the arrangement of FIG. 2, a standard shot peening gun 14 (refer also back to FIG. 1) could be used by also mounting a force sensor 38 as shown in FIG. 1.

Figure 3:
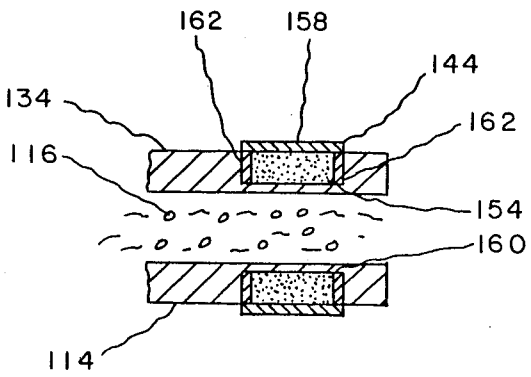
FIG. 3 shows a side cross section view of part of a second embodiment sensor.

FIG. 3 shows an alternate arrangement in which a sensor 144 is built into the shot peening gun 114 to sense shot in a zone within the shot blast path 116. It will be noted that the components of the embodiment of FIG. 3 have the same last two digits as the corresponding component, if any, of the embodiment or arrangement of FIG. 2. The sensor 144 is built into the gun 114 adjacent the tip of the nozzle 134. In particular, the nozzle 134 has a cylindrical depression 160 in which the coil 154 is seated. Additionally, the cylindrical steel flux concentrator 158 has side surfaces 162 which extends downwardly towards the cylindrical depression 160. The sensor 144 operates as the sensor 44 and in conjunction with a sensing circuit (not shown). Since polyethylene is very abrasion resistant, it may be used for the material at the nozzle 134 of gun 114.

Before proceeding to explain how the sensors 38 and 44 may be used to determine the mass flow rate R and the average shot particle velocity v, some mathematics may be useful.

Newton's second law of motion provides that a force is equal to the change in the amount of motion, the amount of motion being mass m times velocity v which may be stated as follows:

$$F = \frac{d}{dt}(mv) = m\frac{dv}{dt} + v\frac{dm}{dt} \tag{4}$$

Typically, the above equation reduces to F=ma where a is the acceleration, this corresponding to the first term of the right side of Equation 4 wherein the force is applied to a body of constant mass. However, in the case of a shot peening gun under steady state conditions, the first term is zero because the velocity does not change. Accordingly, the force is equal to the velocity times the mass differential. The application of Equation 4 to a shot stream may be thought of as somewhat analogous to withdrawing a rope from a box by pulling at a constant velocity. The first term of the equation is zero because the time differential of the velocity is zero. However, the second term of Equation 4 would be applicable in that the mass of the rope is changing as more is pulled from the box. In somewhat similar fashion, the change in the amount of motion of a stream of shot is its mass flow rate times its velocity. Thus, the velocity v of a stream of shot is equal to:

$$v = F_s/R \tag{5}$$

where R is used to indicate the mass flow rate corresponding to dm/dt, v is the average velocity of the shot stream, and $F_s$ is the force of the shot stream.

Equation 5 and the Equation 3 discussed in detail above provide two equations with two unknowns. It should be noted that in the discussion of the magnetic densitometer of Model 260 Equation 3 could be solved because the velocity of the shot was a known constant corresponding to freely-falling shot. Although Equation 3 is applicable to the sensor 44 (FIG. 1) only the mass of the ferromagnetic shot within the coil and the length of the coil are known. The unknown mass flow rate R and the unknown average shot velocity v may be determined by using Equation 3 in conjunction with Equation 5.

Solving for v in Equation 3 results in the following:

$$v=RL/m \quad (6)$$

equating the right side of Equation 6 and the right side of Equation 5 indicates that:

$$F_s/R=v=RL/m \quad (7)$$

solving Equation 7 for R shows that $$R=(F_s m/L)^{\frac{1}{2}} \quad (8)$$

Substituting in the above result for R in Equation 5 results in:

$$v=(F_s L/m)^{\frac{1}{2}} \quad (9)$$

From the above, it will be seen that the average shot velocity v and the mass flow rate R can be determined by knowledge of the reaction force, the mass of shot within the coil at a particular time, and the known length of the coil. (The ½ exponential is used to indicate a square root in the equations.)

Figure 4:
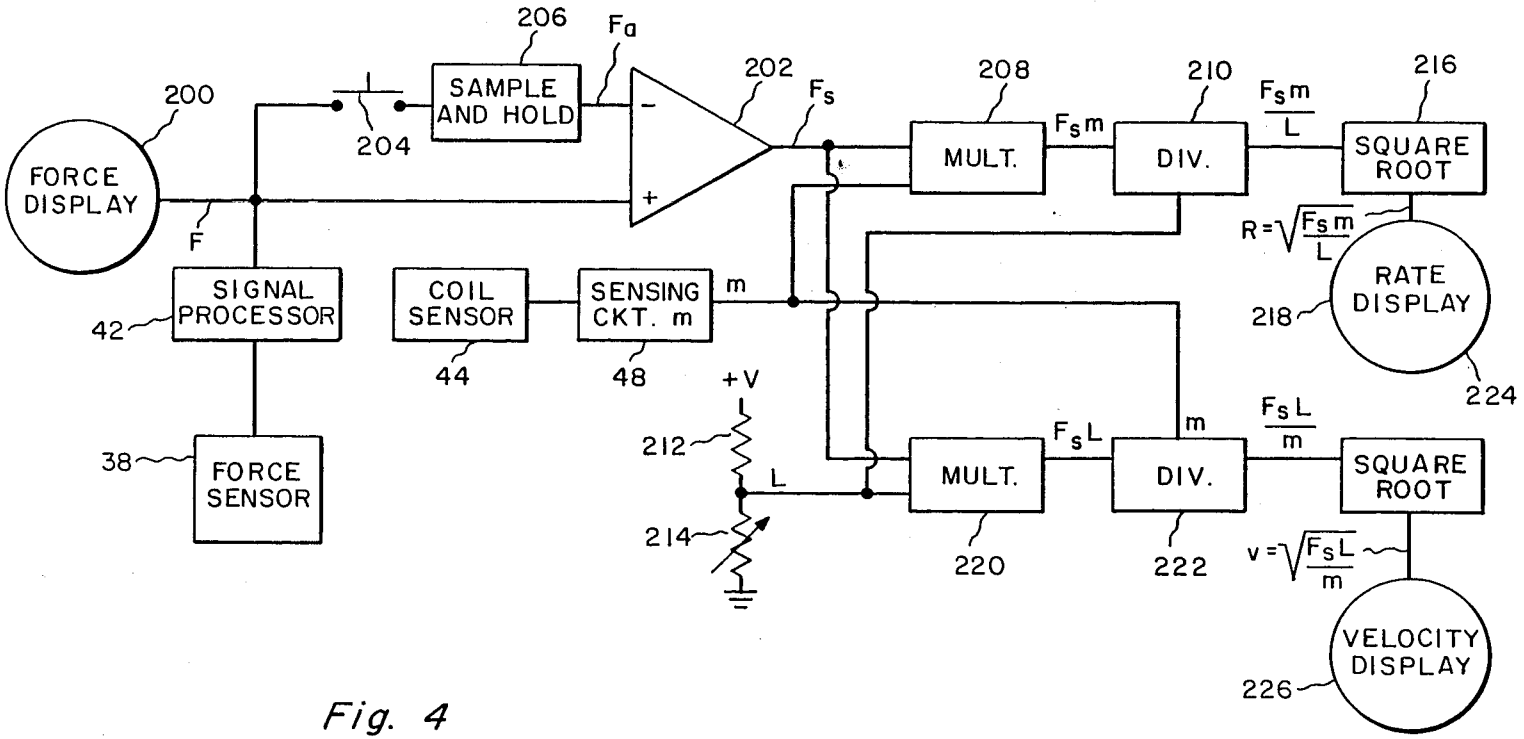
FIG. 4 shows the electrical system of the present invention including several components also shown in FIG. 1.

Equations 8 and 9 are executed by the arrangement of FIG. 4. The output of the signal processor 42 is F, a signal corresponding to the reaction force of the gun from ejecting the shot and the air. This signal may be provided to a force display 200 such that an operator may observe the total reaction force of the gun, which force is equal to magnitude and opposite in direction from the force of the shot and air expelled from the gun. The force signal is further supplied to the positive input of a differential amplifier 202. The differential amplifier 202 has a negative input connected to the force signal by way of switch 204 and sample and hold circuit 206. Differential amplifier 202 allows one to most accurately obtain the reaction force of the gun due to the shot being expelled. In particular, when the air is being expelled from the gun, but before the operator has turned on the flow controller 24 (FIG. 1 only) all of the reaction force sensed by the sensor 38 will be due to the air. Accordingly, during that time, the operator may depress the momentary switch 204 such that sample and hold circuit 206 will store a signal $F_a$ corresponding to the reaction force due to air alone. That air reaction force signal $F_a$ is supplied to the negative terminal of differential amplifier 202. Accordingly, when the operator turns on the flow controller 24 so that shot peening has started, the previously stored voltage level from sample and hold circuit 206 will be subtracted from the total force signal F so as to derive a signal or voltage level $F_s$ corresponding to the reaction force due to the shot alone.

The $F_s$ output of differential amplifier 202 is supplied to the multiplier 208 which multiplies by a signal m corresponding to the mass within the coil of coil sensor 44. The output of multiplier 208 is supplied to divider 210 which divides the product of multiplier 208 by a signal L representative of the known coil length. As shown the signal L may simply be a constant voltage derived from a voltage divider having resistor 212 and variable resistor 214. The output of divider 210 is supplied to a square root circuit 216 which takes the square root of the output of divider 210. The result is the mass flow rate signal R which may be displayed in the rate display 218.

Multiplier 220, divider 222, and square root circuit or function generator 224 are used in similar fashion to provide a signal v corresponding to the average particle velocity which may be displayed by velocity display 226.

Figure 5:
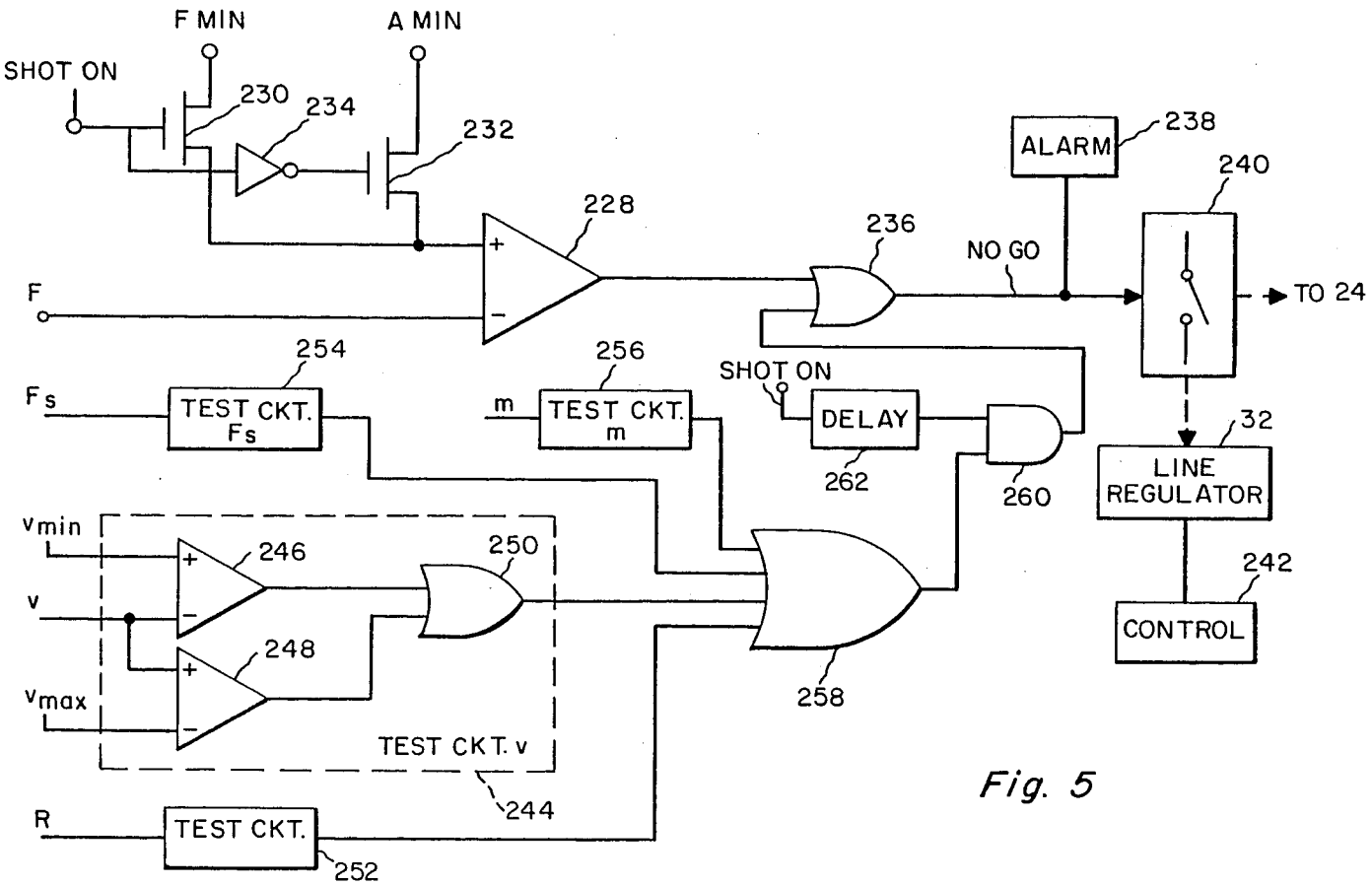
FIG. 5 shows an alarm arrangement which may be used with the present invention.

With reference now to FIG. 5, alarm circuitry for use with the arrangement of FIG. 1 is shown. The circuit of FIG. 5 is part of the same circuit as FIG. 4, but is shown by a separate figure for ease of illustration. Various signals from the circuit of FIG. 4 are supplied to the circuit of FIG. 5 as will be discussed.

The signal F corresponding to the output of signal processor 42 in FIG. 4 is supplied to a comparator 228 of FIG. 5. It should be appreciated that the reaction force F is the overall reaction force or recoil of the gun 14 due to the ejection of the shot and due to the ejection of the gas. If this reaction force is too low, it is indicative of a malfunction such as a clog in the shot feed line 18 or a leak in the air conduit or feed line 28. Accordingly, the comparator 228 serves as a comparison means to ensure that the force signal F has a predetermined minimum value. In the arrangement of FIG. 5, the comparator 46 compares force signal F to a signal FMIN or to a voltage AMIN. In particular, the alternate voltages are supplied by controlled switches 230 and 232, which may be FETs as shown.

The gate of switch 230 is supplied with a SHOT ON signal which would be high or positive when shot is being expelled from the gun. When shot is not being expelled, the signal would be zero. The SHOT ON signal may be supplied by simply using the voltage supplied to turn on the flow controller 24 of FIG. 1. Although not separately shown in FIG. 1, the flow controller 24 would of course have a power circuit which supplies it power when it is to dispense or allow passage of shot therethrough. The same known signal for supplying power to the controller 24 may be used as the SHOT ON signal or, alternately, the SHOT ON signal may be provided by converting of the power to controller 24 to a different voltage level or type of signal.

When the SHOT ON signal is low corresponding to no shot being delivered to the gun, the switch 232 will be turned on by way of inverter 234, but the switch 230 will be off or open. Accordingly, the voltage AMIN will be supplied to the comparator 228 for comparison with the force signal F. The voltage AMIN corresponds to the minimum reaction force which should be sensed whenever the line regulator 32 is supplying air to the shot peening gun even if no shot is being expelled. When the flow controller 24 is turned on to begin supplying shot to the gun, the SHOT ON signal is supplied such that switch 232 turns off and switch 230 turns on. The comparator 228 will now compare the total force signal F with the voltage FMIN which corresponds to the minimum reaction force which should be sensed when the gun is ejecting shot.

As will be readily appreciated, the voltage levels FMIN and AMIN, corresponding respectively to minimum reaction force with shot flow and minimum reaction force without shot flow, may be set by voltage dividers having variable resistors to allow for user adjustment similar to resistors 212 and 214 of FIG. 4.

If the force signal F is less than the selected minimum value (depending upon whether shot is being ejected), the comparator 228 will have a positive output when the total force signal F is below the minimum. The positive output of the comparator 228 is supplied to an OR gate 236, the output of which is a NO GO signal.

The NO GO signal is supplied to an alarm 238. Additionally, the signal may be supplied to a controlled power switch 240 so as to turn off power to the system. The power switch 240, which may be a relay, switching transistor, or other control switch, turns of the shot peening operation. The power switch 240 may turn off the flow of power to the flow controller 24 or otherwise stop it from supplying shot to the gun. Additionally, the power switch 240 may turn off the flow of power to the line regulator 32 or otherwise stop it from allowing air to pass to the gun. The line regulator 32 includes a suitable control 242 which may be set to establish the air pressure supplied to the gun. The sounding of the alarm 238 alerts an operator that the shot peening operation has been halted.

In addition to halting the shot peening operation and sounding an alarm if the overall reaction force is below the selected minimum value, the circuit of FIG. 5 includes a series of test circuits which are used to ensure that other system parameters are within acceptable ranges.

As shown, a test circuit 244 for testing the value of v includes a comparator 246 and a comparator 248. If the velocity signal v is below the minimum acceptable velocity vmin or higher than a maximum acceptable velocity vmax, the appropriate comparator 246 and 248 outputs a positive signal which will be gated through an OR gate 250. If the output of OR gate 250 is positive, that indicates that the test circuit 244 has determined the velocity signal v to be outside of the boundary of acceptable ranges.

Test circuits 252, 254 and 256 may be constructed in identical fashion to test circuit 244 and used to compare the values of the mass flow rate signal R, the shot reaction force signal $F_s$, and the coil mass signal m to ensure that each of those signals is within acceptable ranges. If those signals fall outside of the range of acceptability, it is indicative of some malfunction. For example, if the value of m becomes too low, it indicates that insufficient shot is getting to the gun such that a clog between the shot hopper 22 (FIG. 1 only) and the gun 14 may have occurred. The acceptable minimum and maximum values for the four values, v, R, $F_s$ and m may be set by adjustable voltage dividers similar to the arrangement of resistors 212 and 214 in FIG. 4. Although all of the test circuits 244, 252, 254 and 256 may be identically constructed, one could alternately use simpler versions which only ensure that a value has not fallen below a minimum or simpler versions which only ensure that a value has not exceeded a maximum value. The outputs of the various test circuits 244, 252, 254 and 256 are supplied to an OR gate 258. When the output of the gate 258 is high, it indicates that at least one of the four tested parameters is outside of its proper range.

Since one or more the four parameters tested by the test circuits may initially be outside the desired range until the shot peening operation has reached a steady state, the output of gate 258 is supplied to an AND gate 260, the other input of which is connected to a delay 262 which receives the SHOT ON signal. Accordingly, the indication of a malfunction by reason of one or more of the four signals being outside acceptable ranges will not be transmitted by gate 260 unless the signal remains outside the acceptable range after a given time delay set by delay 262 from the turning on of the shot peening operation. The output of gate 260 is supplied to the OR gate 236.

The operation of the system is relatively straightforward. With reference to FIG. 1, upon powering up the line regulator 32, an air stream will be ejected from the gun 14. The flow controller 24 remains closed such that no shot will be expelled. The operator may then momentarily depress the button 204 to sample and hold the reaction force due to the ejected air with reference now to FIG. 4. When air only is being ejected, the comparator 228 (FIG. 5) ensures that the overall reaction force is not so low as to be indicative of an air leak or other malfunction. The switch 204 is opened after sampling of the reaction force signal and the power is supplied to the flow controller 24 so as to allow shot to begin flowing to the gun 14. The power is supplied by a standard power circuit for a flow controller and a SHOT ON signal indicative of the beginning of shot peening operations is supplied to the alarm circuitry of FIG. 5. The differential amplifier 202 supplies the force signal $F_s$, whereas the coil sensor 44 (or 144 of FIG. 3) is used to supply a mass signal m. These later two signals are combined with a signal representative of the length of the coil to perform the necessary calculations, determining the mass flow rate R and the average shot particle velocity v.

Following a short delay from the turning on of the flow controller 24 (which delay is established by delay 262), the various test circuits 244, 252, 254, and 256 determine if the associated signals are within acceptable ranges. If not, the gate 260 will output a positive pulse which will pass through the gate 236 and be supplied as a NO GO signal to the alarm 238 and the power control switch 240.

Although the system as shown calculates R and v based on $F_s$, one might alternately use F and either accept less accuracy or compensate for the reaction force due to the air by some other method such as taking into account the pressure of the air supplied to the gun (e.g., figuring the reaction force due to the air from that pressure). More generally, the calculations could be $F_x$ where $F_x$ is the force signal F or some signal derived therefrom.

Although various specific embodiments and arrangements have been disclosed herein, it is to be understood that these are for illustrative purposes only. Various modifications and adaptations will be apparent to those skilled in the art. For example, although the various circuit arrangements show circuit components which perform calculations upon analog signals, one could alternately use digital components to provide the multiplication, division, and square root functions. Further, one could use a microprocessor to perform the indicated operations. Accordingly, reference should be made to the claims appended hereto to determine the full scope of the present invention.

What is claimed is:

1. A shot peening system comprising:

a mount base;

a gun for shot peening, said gun having a nozzle with an outlet, said gun supported by said mounting base;

a force sensor operable to sense the reaction force from operation of said gun and to generate a force signal F based on the reaction force;

a sensor adjacent said outlet and operable to sense the amount of shot within a zone in a shot blast path and to generate an amount signal m based on the sensed shot; and calculation means operable to receive said signal F and m and operable to calculate a shot peening parameter selected from the group of:
R the mass flow rate and
v the average shot particle velocity.

2. The shot peening system of claim 1 wherein the calculation means is operable to calculate both R and v and further comprises display means to display the mass flow rate and the average shot particle velocity.

3. The shot peening system of claim 2 wherein the calculation means is operable to calculate R and v by performing the following equations:

$$R=(F_s m/L)^{\frac{1}{2}}$$

$$v=(F_s L/m)^{\frac{1}{2}}$$

where $F_s$ is that portion of F due to the reaction force from the expulsion of shot and L is a dimension of said zone.

4. The shot peening system of claim 1 wherein said sensor includes a coil adjacent said outlet and a sensing circuit for sensing the amount of shot within the coil by sensing the inductance of the coil.

5. The shot peening system of claim 4 wherein said coil is wound around said nozzle.

6. The shot peening system of claim 4 wherein said coil is wound around a core of non-ferromagnetic material to said nozzle.

7. The shot peening system of claim 4 wherein the calculation means is operable to calculate both R and v and further comprising display means to display the mass flow rate and the average shot particle velocity.

8. The shot peening system of claim 4 wherein the calculation means is operable to calculate R by performing the following equation:

$$R=(F_x m/L)^{\frac{1}{2}}$$

where $F_x$ is the force signal F or a signal derived therefrom and L is a signal representative of the length of said coil.

9. The shot peening system of claim 4 wherein the calculation means is operable to calculate v by performing the following equation:

$$v=(F_x L/m)^{\frac{1}{2}}$$

where $F_x$ is the force signal F or a signal derived therefrom and L is a signal representative of the length of said coil.

10. The shot peening system of claim 4 further comprising an alarm and a test circuit operable to detect malfunction conditions and operable to actuate said alarm upon detection of a malfunction condition.

11. The shot peening system of claim 1 further comprising an alarm and a test circuit operable to detect malfunction conditions and operable to actuate said alarm upon detection of a malfunction condition.

12. The shot peening system of claim 1 further comprising a power switch and a test circuit operable to detect malfunction conditions and operable to turn off said power switch to halt shot peening upon detection of a malfunction condition.

13. A method of shot peening comprising the steps of:
supplying shot to a gun for shot peening; operating the gun to expel shot from a nozzle of the gun;
sensing the amount of shot in a zone adjacent a nozzle outlet of the gun and in a shot blast path;
generating an amount signal m based on the sensed amount;
sensing reaction force of the gun to expulsion of the shot;
generating a force signal F based on the sensed force;
calculating a parameter selected from the group of:
R the mass flow rate, and
v the average shot particle velocity
by use of the force signal F and the amount signal m.

14. The method of claim 13 further comprising the step of:
displaying the parameter which was calculated.

15. The method of claim 13 wherein both R and v are calculated.

16. The method of claim 15 further comprising the step of:
displaying the mass flow rate and the average shot particle velocity.

17. The method of claim 13 wherein the calculation step includes calculating R and v by performing the following equations:

$$R=(F_s m/L)^{\frac{1}{2}}$$

$$v=(F_s L/m)^{\frac{1}{2}}$$

where $F_s$ is that portion of F due to the reaction force from the expulsion of shot and L is a dimension of said zone.

18. The method of claim 13 wherein said sensing of the amount is accomplished by a coil adjacent the outlet and a sensing circuit which senses the shot within the coil by sensing the inductance of the coil and generates the amount signal m.

19. The method of claim 13 further comprising the steps of:
testing for malfunction conditions; and
actuating an alarm upon detection of a malfunction condition.

20. The method of claim 13 further comprising the steps of:
testing for malfunction conditions; and
stopping the operation of the shot peening gun upon detection of a malfunction condition.

* * * * *